US006367482B1

(12) United States Patent
Baltheiser

(10) Patent No.: US 6,367,482 B1
(45) Date of Patent: Apr. 9, 2002

(54) MANICURE CAPSULE

(76) Inventor: Karl Baltheiser, Fritz-Pfaffinger-Weg 10, Bad Feilnbach (DE), D-83075

( * ) Notice: Subject to any disclaimer, the term of this patent is extended or adjusted under 35 U.S.C. 154(b) by 0 days.

(21) Appl. No.: 09/763,320

(22) PCT Filed: Apr. 6, 2000

(86) PCT No.: PCT/EP00/03091

§ 371 Date: Feb. 22, 2001

§ 102(e) Date: Feb. 22, 2001

(87) PCT Pub. No.: WO01/01814

PCT Pub. Date: Jan. 11, 2001

(30) Foreign Application Priority Data

| | | |
|---|---|---|
| Jul. 6, 1999 | (DE) | 299 11 680 U |
| Aug. 3, 1999 | (DE) | 299 13 503 U |
| Aug. 16, 1999 | (DE) | 299 14 345 U |
| Sep. 20, 1999 | (DE) | 299 16 522 U |
| Dec. 8, 1999 | (DE) | 299 21 597 U |
| Dec. 23, 1999 | (DE) | 299 22 679 U |

(51) Int. Cl.[7] ..... A45D 29/20
(52) U.S. Cl. ..... 132/75; 132/75.4; 132/75.6
(58) Field of Search ..... 132/73, 73.5, 75, 132/75.4, 75.5, 76.2, 75.6; 30/26, 27, 28, 29, 124, 125, 231, 232

(56) References Cited

U.S. PATENT DOCUMENTS

| | | | | |
|---|---|---|---|---|
| 1,383,556 A | * | 7/1921 | Mothe | 132/76.2 |
| 2,620,560 A | * | 12/1952 | Bahr | 132/75.4 |
| 4,341,015 A | * | 7/1982 | Young | 132/76.2 |
| 4,956,915 A | | 9/1990 | Anderson | |
| 5,046,606 A | | 9/1991 | Morelli | |
| 5,832,610 A | | 11/1998 | Chaplick | |

FOREIGN PATENT DOCUMENTS

| | | |
|---|---|---|
| DE | 197 51 097 | 5/1998 |
| DE | 299 13 503 | 10/1999 |
| DE | 299 14 345 | 10/1999 |
| DE | 299 22 679 | 3/2000 |
| FR | 615 654 | 1/1927 |

* cited by examiner

*Primary Examiner*—Todd E. Manahan
(74) *Attorney, Agent, or Firm*—Nixon & Vanderhye

(57) ABSTRACT

The invention relates to a manicure capsule comprising a collecting receptacle (1) for nail clippings which is provided with at least one lateral insertion opening (7) for nail scissors. The end section (5) of the collecting receptacle (1) for nail clippings which encloses the finger insertion opening (12) is configured as a holding section for a holding part which is provided for at least one pair of scissors (3) and which can be detachably fastened to the end section (5), or is configured as a holding section for a holding part which is provided for holding the collecting receptacle (1) for nail clippings on the finger and which can be detachably fastened to the end section (5).

18 Claims, 7 Drawing Sheets

Figure 1:
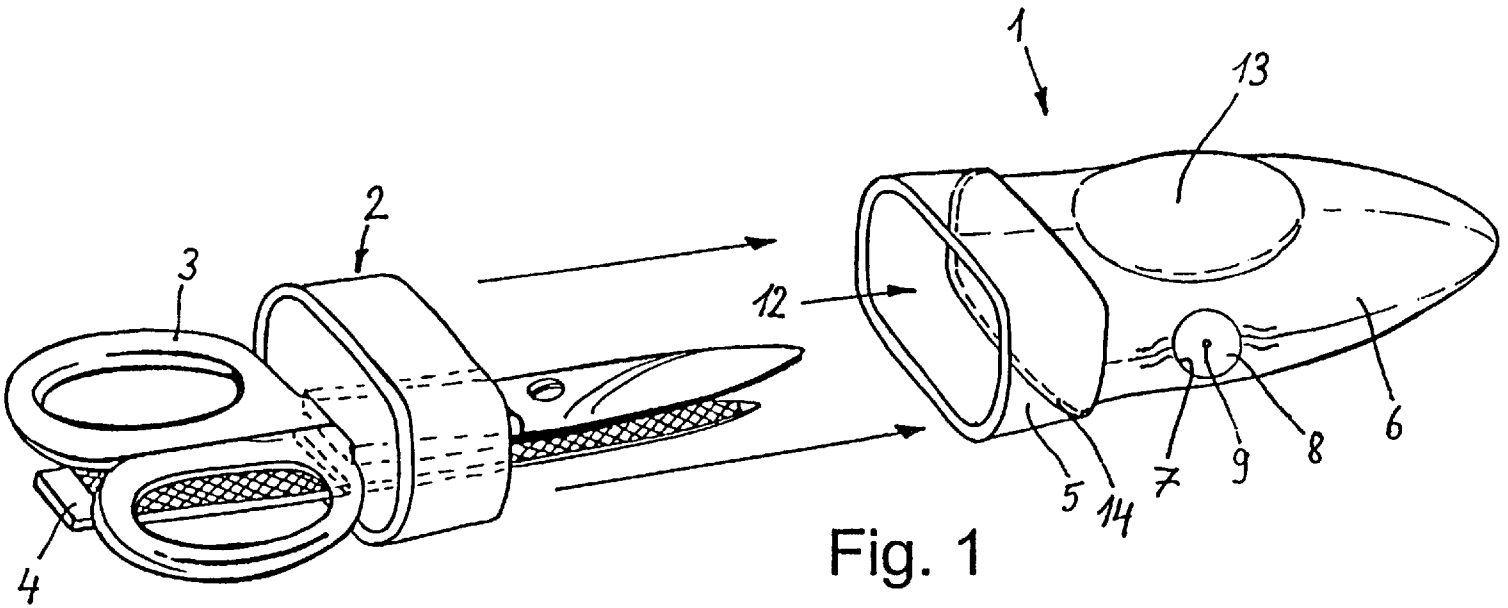

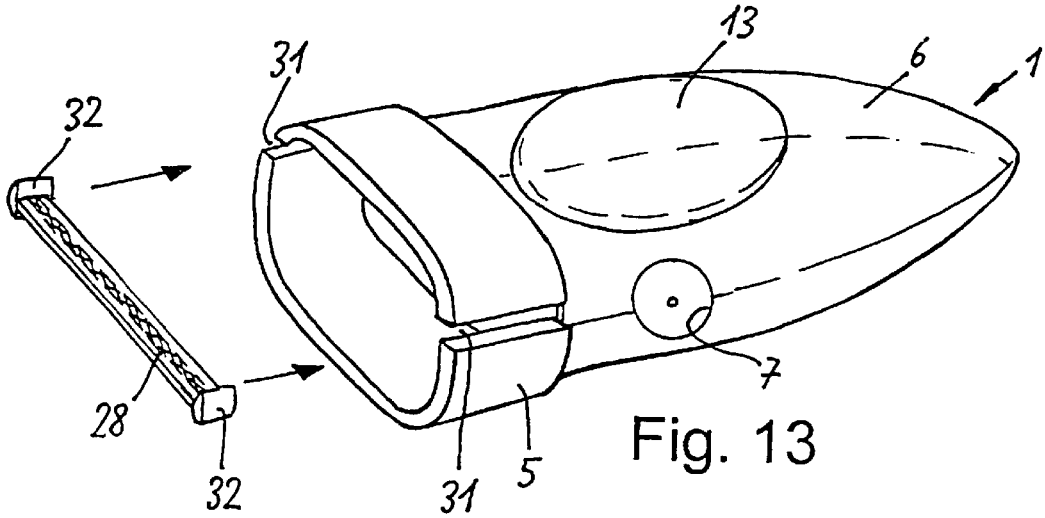
Fig. 13
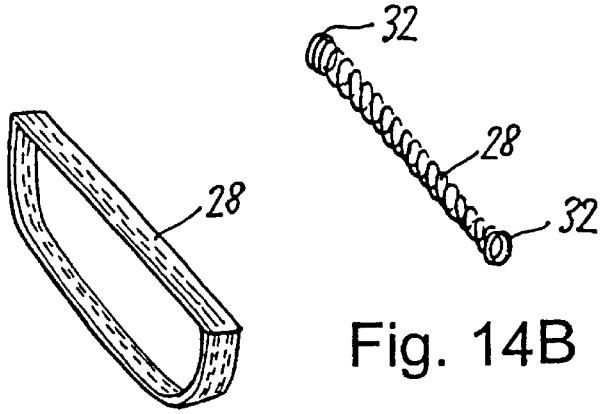
Fig. 14B
Fig. 14A
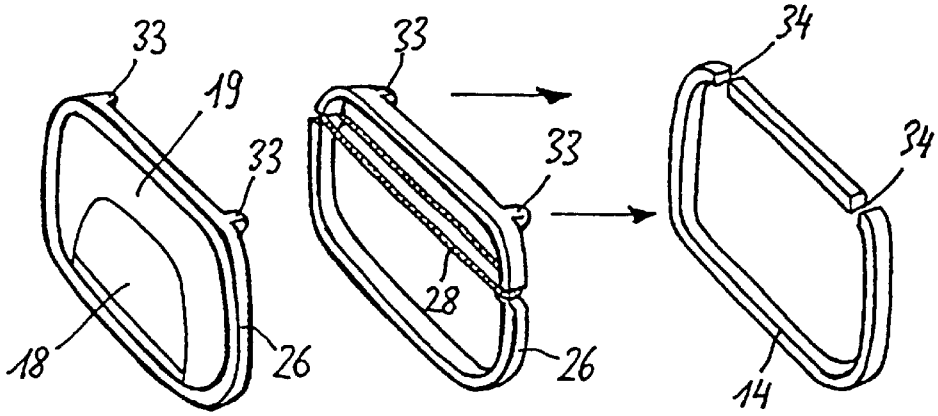
Fig. 15

MANICURE CAPSULE

The invention relates to a manicure capsule according to the preamble of claims 1 and 4.

When fingernails are cut, there is the problem of the fingernails flying off in an uncontrolled manner as they are cut. The same applies for cutting toenails and skin or horny tissue in the region of the fingers and toes. This necessitates additional effort to be made as far as cleaning is concerned. Furthermore, it is also undesirable from the point of view of hygiene. This is a particular problem for elderly and also visually impaired individuals who have difficulty in finding the scattered horny-tissue material again and disposing of the same. For bedridden individuals, it is particular unpleasant if the cut-off horny tissue drops onto the bed.

U.S. Pat. No. 4,956,915 has already disclosed a manicure capsule of the type mentioned in the introduction which, on the side which is located opposite the finger-insertion opening, has an opening for the insertion of nail clippers. The disadvantage with this known manicure capsule, however, is that its area of use is very restricted and it can only be used for nail clippers, and not nail-scissors.

The object of the invention is to provide a manicure capsule which is suitable for cutting nails using scissors, can be used, as far as possible, universally and allows cut-off horny tissue to be collected reliably.

This object is achieved according to the invention by the features of claims 1 and 4. Advantageous embodiments of the invention are described in the rest of the claims.

According to Patent claim 1, the clippings-collecting container has at least one lateral nail-scissors-insertion opening. That end section of the clippings-collecting container which encloses the finger-insertion opening is designed as a retaining section for a retaining part which can be fastened releasably on the end section and is intended for at least one pair of scissors.

By way of the lateral nail-scissors-insertion opening, nail scissors can be inserted into the clippings-collecting container, transversely to the longitudinal direction of the manicure capsule, such that the fingernails can easily be cut from all sides. For this purpose, the nail-scissors-insertion opening is dimensioned such that the scissors can be pivoted correspondingly in order to cut the fingernail with the appropriate rounding. The pushed-in scissors also act, at the same time, as a handle for stabilizing the manicure capsule, it being possible for the manicure capsule to be moved by means of the scissors should this be necessary in order to obtain the optimum cutting position. The nails are collected in the clippings-collecting container and can be specifically disposed of once the manicuring has been completed. The fingernails are reliably prevented from flying off in an uncontrolled manner. It is particularly advantageous that that end section of the clippings-collecting container which encloses the finger-insertion opening is designed as a retaining section for a retaining part which can be fastened releasably on the end section and is intended for at least one pair of scissors since, as a result, at least one pair of scissors and expediently also other manicuring implements, for example an additional file, can be fastened on the retaining part and inserted into the finger-insertion opening at least by way of their front end, with the result that, in this case, the manicure capsule can also be used as a case which protects the manicuring implements and fixes them in place. In this case, the manicure capsule thus serves as a space-saving storage and retaining container for the manicuring implements.

It should be noted that the use of the term "fingernails" is not intended to indicate in any way a restriction to this type of horny tissue. Rather, the effects and advantages achieved by the invention also apply in the same way to cutting toenails and skin parts and to filing using a nail file in the region of fingers and toes. One advantage of the subject matter of the invention is precisely that it can be used universally and can readily be designed such that it is suitable both for fingers and for toes.

According to an advantageous embodiment, the retaining part for at least one pair of scissors is designed as a retaining stopper which can be plugged into the end section or a retaining cap which can be plugged onto the end section. On account of its longitudinal extent, a retaining part shaped in this way provides for the retaining stopper or the retaining cap to be seated firmly on the clippings-collecting container. Furthermore, such retaining stoppers or retaining caps are cost-effective and easy to produce.

Secure fixing of the manicuring implements in the retaining part is achieved in that the at least one pair of scissors and, if appropriate, also additional nail files are plugged into corresponding slits of the retaining part. These slits may be designed such that the manicuring implements are retained in the slit region solely by the elastic clamping force.

According to Patent claim 4, the clippings-collecting container has at least one lateral nail-scissors-insertion opening. That end section of the clippings container which encloses the finger-insertion opening is designed as a retaining section for a retaining part which can be fastened releasably on the end section and is intended for securing the clippings-collecting container on the finger.

In this embodiment, the lateral nail-scissors-insertion opening, in turn, provides the same advantages as in the first-mentioned embodiment. However, in this case, that end section of the clippings-collecting container which encloses the finger-insertion opening serves for accommodating a retaining part for securing the clippings-collecting container on the finger, with the result that the manicure capsule can be fastened releasably on the finger. This avoids the situation where the manicure capsule slips off from the finger during cutting. Furthermore, this last-mentioned retaining part may readily be designed such that it additionally prevents cut-off fingernails from escaping accidentally through the finger-insertion opening.

There is advantageously provided in the clippings-collecting container an encircling clippings-retaining bead which projects radially inward from the container wall and bounds the collecting section in the direction of the end section. Said clippings-retaining bead prevents the cut-off horny tissue from escaping accidentally through the finger-insertion opening during cutting. It is particularly advantageous here that such a clippings-retaining bead is very easy and cost-effective to produce.

The embodiments of claims 7 and 8 allow the manicure capsule to be retained reliably on the finger and, at the same time, provides a sealed termination of the finger-insertion opening during cutting.

The embodiment according to claim 9 provides the advantage of very easy and cost-effective production.

It is also possible to provide a hollow fixing stopper which can be plugged into the end section and axially secures the retaining part for securing the clippings-collecting container in the end section.

The embodiment according to claim 11 provides the advantage of easy and cost-effective production and of easy exchangeability of the elastic band.

The clippings-collecting container is advantageously provided with a magnifying glass on its top side and/or underside. This allows the part of the nail which is to be cut to be seen particularly clearly.

In its end region which is located opposite the end section, the clippings-collecting container advantageously has an opening which can be closed by means of a closure stopper. This embodiment provides the advantage that the clippings can very easily be emptied in the forward direction. This is even possible in this embodiment without the manicure capsule being removed from the finger.

The clippings-collecting container advantageously has two diametrically opposite lateral nail-scissors-insertion openings. This means that the manicure capsule can easily be used by both left-handed and right-handed individuals. Furthermore, the selection of the most favorable insertion side for the scissors depends on whether it is the nails of the left hand or of the right hand which are to be cut.

It is particularly advantageous if the clippings-collecting container has a container depression adjoining the nail-scissors-insertion opening laterally. This increases the freedom of movement, i.e. the pivoting capacity, of the scissors and ensures that the scissors can be moved into any necessary position.

The nail-scissors-insertion opening is advantageously closed by an elastic covering part which has a central insertion opening for a manicuring implement. Such an elastic covering part provides the advantage that the scissors are guided in the nail-scissors-insertion opening, i.e. on the manicure capsule, during cutting. This means that the scissors can be guided along the finger nail in a smooth and controlled manner. The scissors serve at the same time here as a stabilizing handle.

Although the nail-scissors-insertion opening is expediently round or oval, it may also comprise an elongate lateral window which is closed by a bristle or lamella screen or else by an elastic rubber or plastic part containing a longitudinal cut. In this case, the scissors can be advanced along the capsule wall rather than the latter acting as a pivot axis.

The clippings-collecting container advantageously has a push-in nail-clippers compartment which is accessible from the front side of said container and is bounded, on the underside, by the base of the clippings-collecting container and by a leg of the nail clippers themselves and, on the top side, by a partition plate which extends obliquely downward from the tip of the clippings-collecting container to the bottom border of the end section. This provides an additional push-in compartment in which it is possible, on the one hand, to store nail clippers and, on the other hand, to collect the clipped-off horny tissue.

Figure 2:
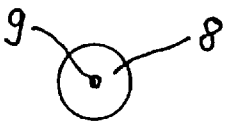
Figure 3A:
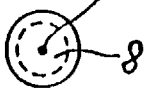
Figure 3B:
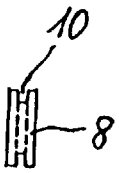
Figure 4:
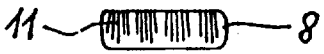
Figure 5:
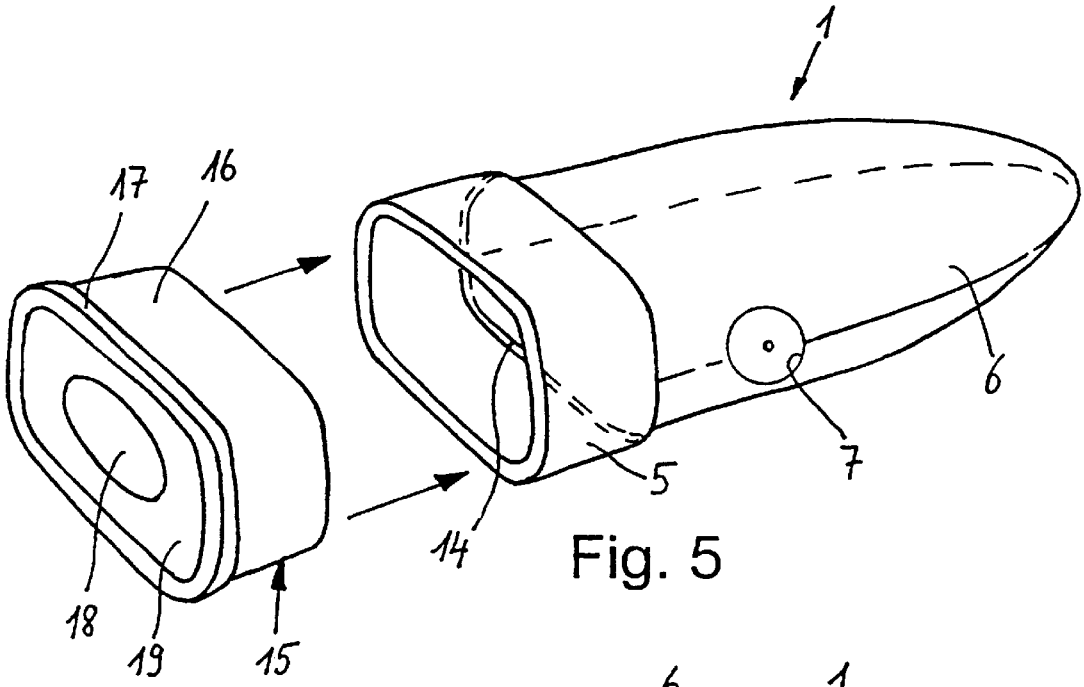
Figure 6:
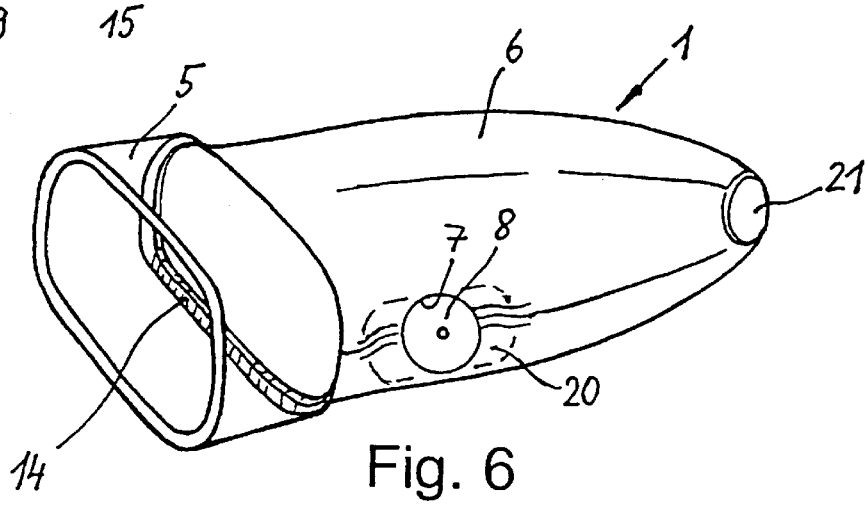
Figure 7:
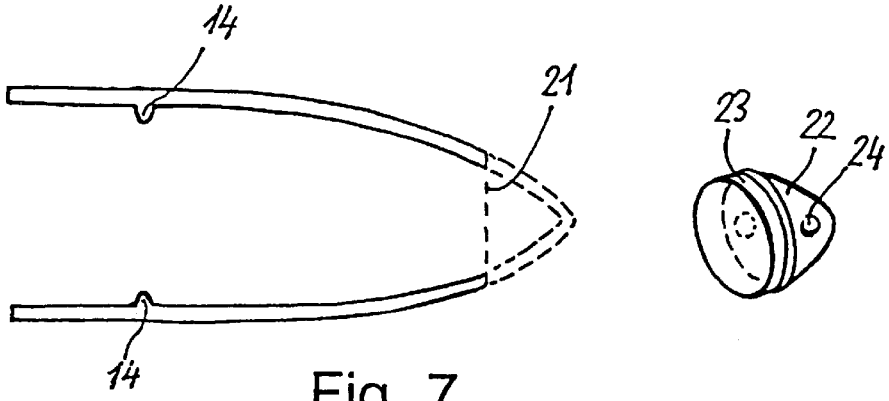
Figure 8:
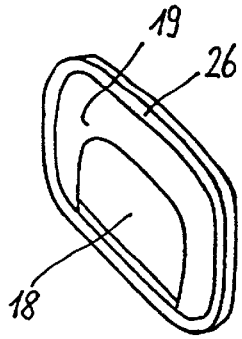
Figure 9A:
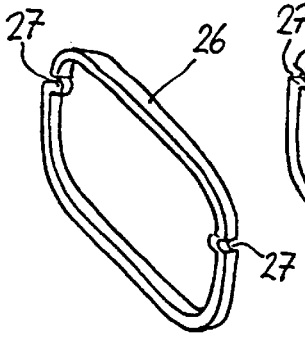
Figure 9B:
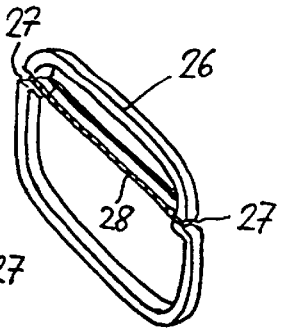
Figure 10:
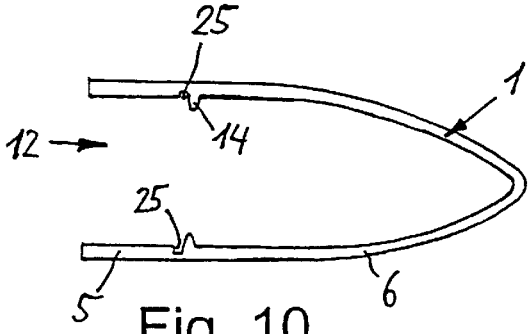
Figure 11:
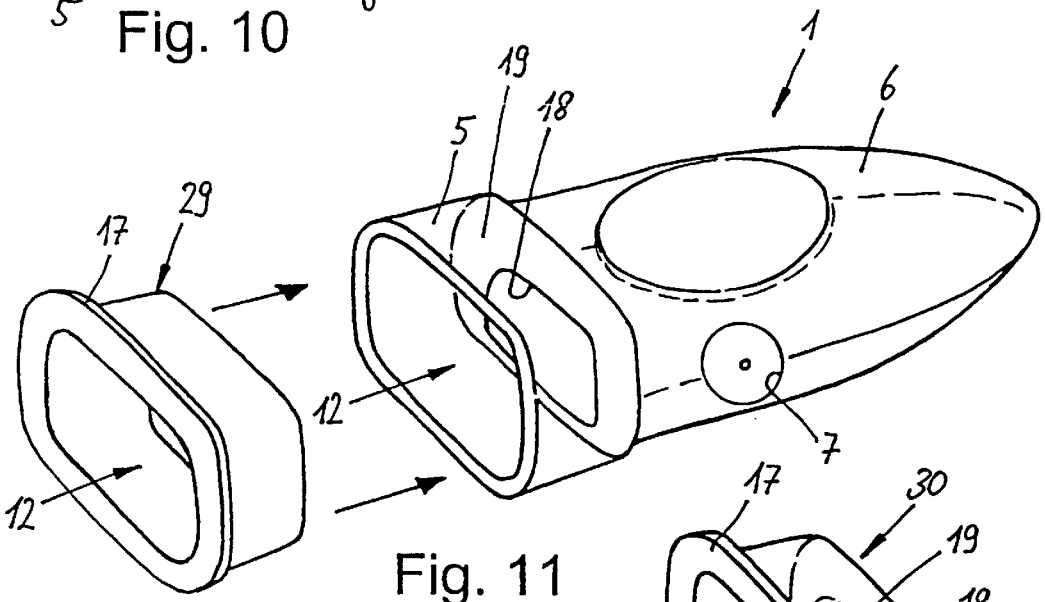
Figure 12:
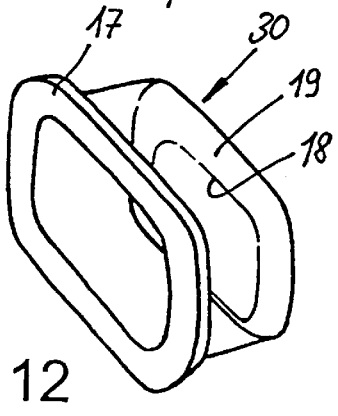
Figure 16:
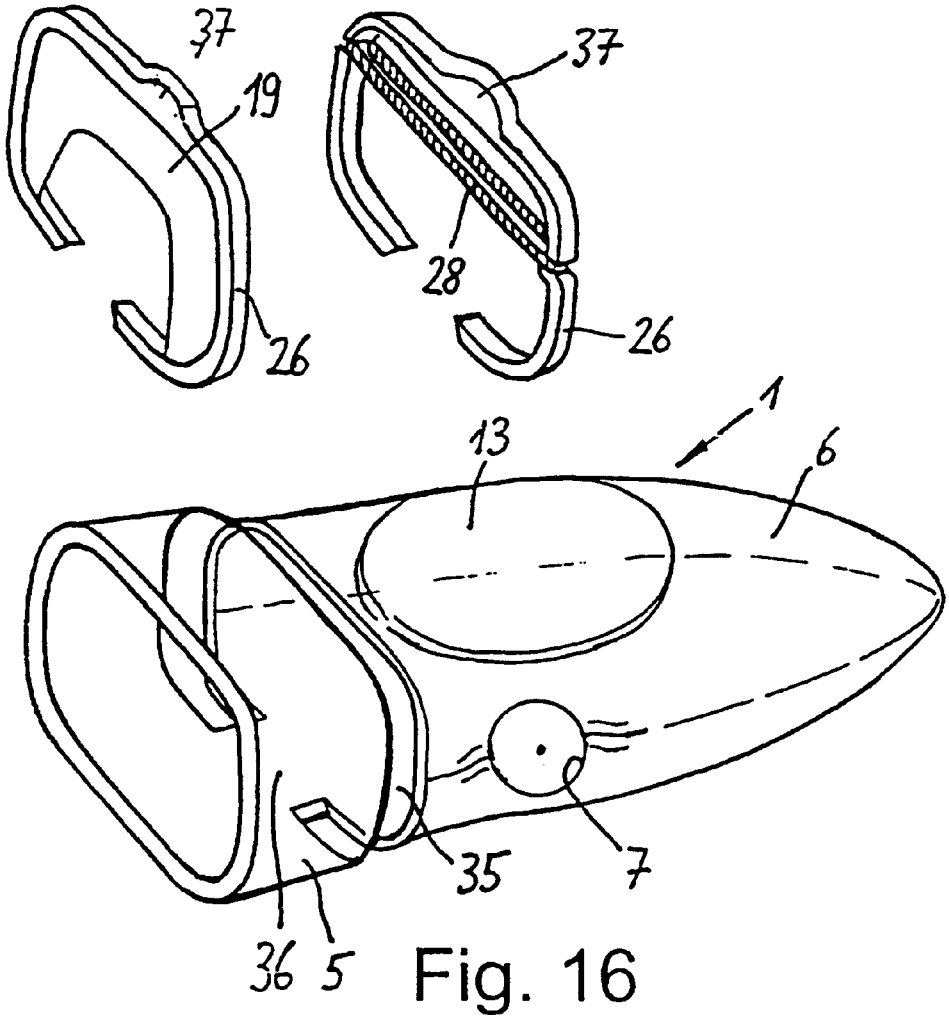
Figure 17:
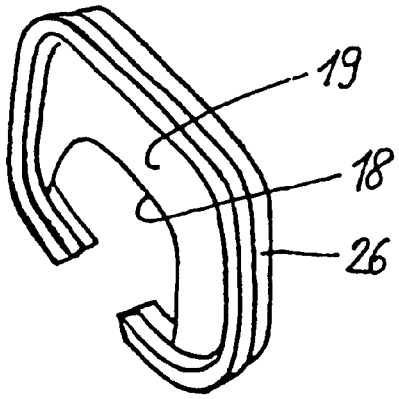
Figure 18:
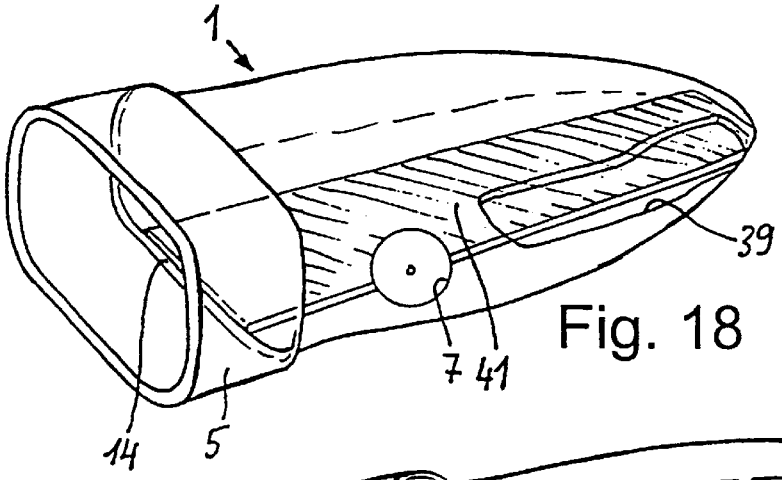
Figure 19:
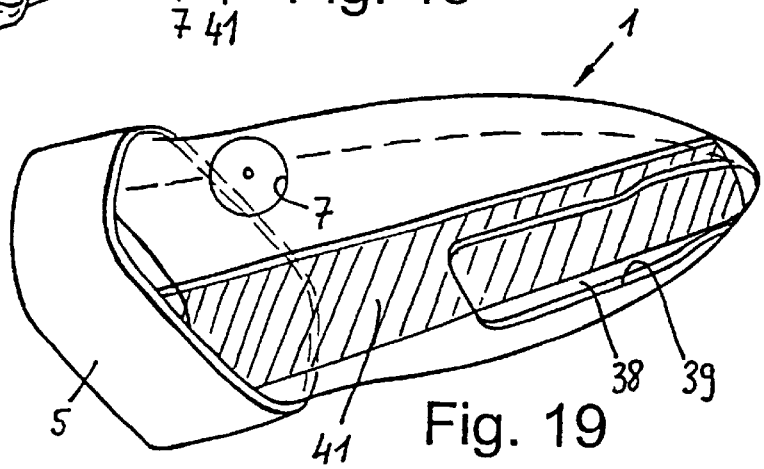
Figure 20:
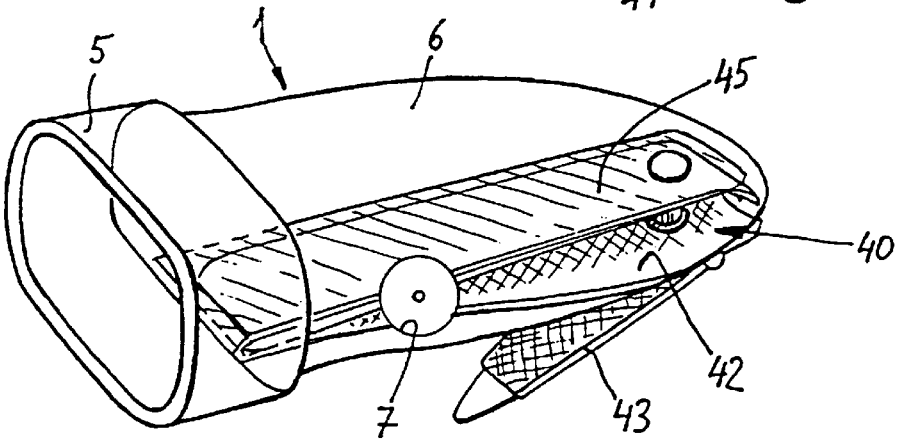
Figure 21:
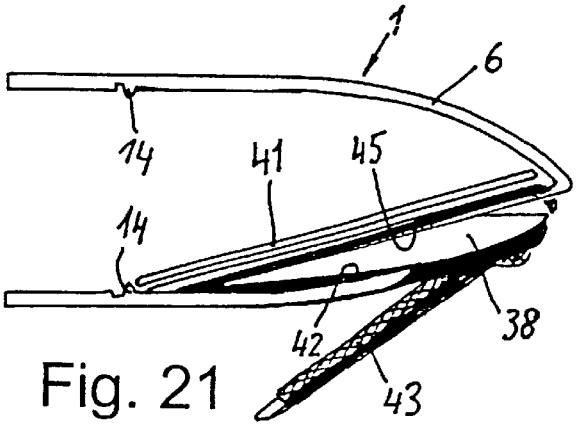
Figure 22:
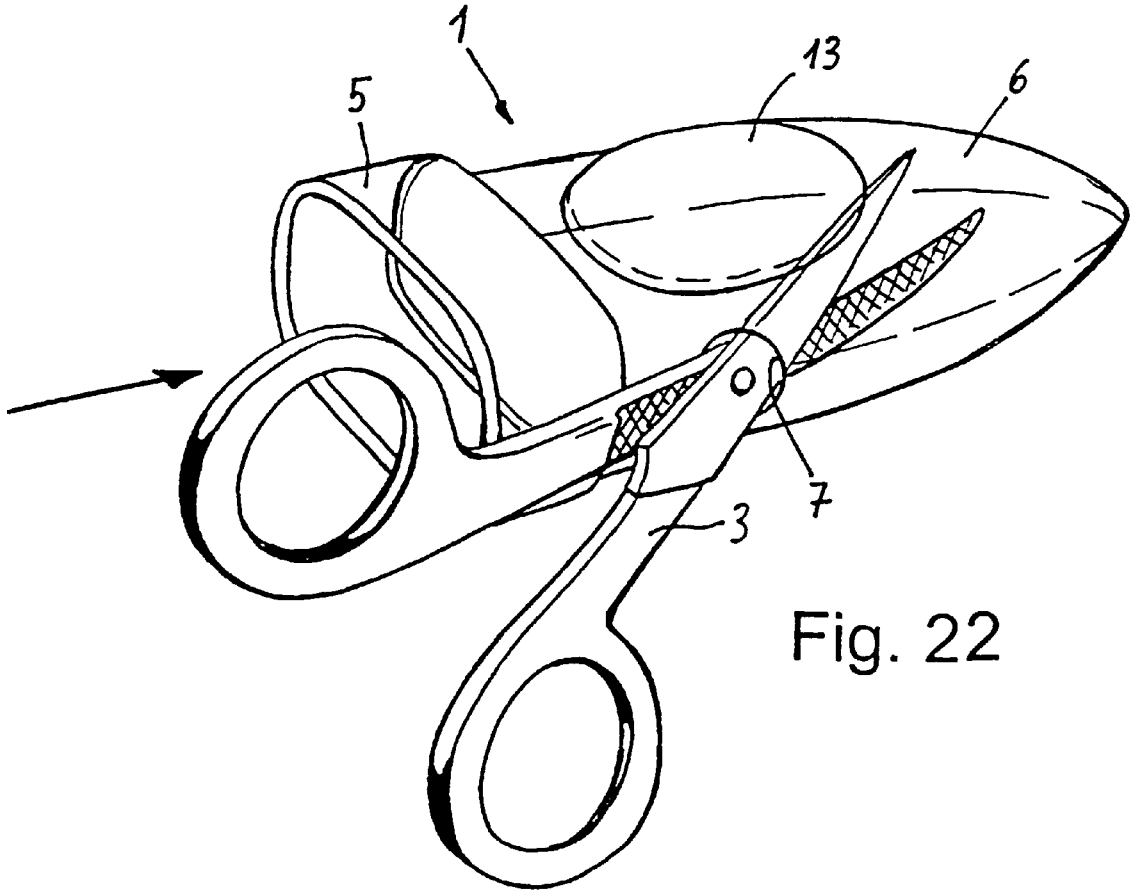

The invention is explained in more detail by way of example hereinbelow with reference to the drawings, in which:

FIG. 1 shows an exploded illustration of a first embodiment of the invention, FIG. 2 shows an illustration solely of the elastic covering part for the nail-scissors-insertion opening, FIGS. 3A and 3B respectively show a front view and a side view of an alternative embodiment of the elastic covering part for the nail-scissors-insertion opening, FIG. 4 shows a further alternative embodiment of the elastic covering part for the nail-scissors-insertion opening in the form of bristles or elastic lamellae, FIG. 5 shows a further embodiment of the manicure capsule according to the invention, FIG. 6 shows a further embodiment of the manicure capsule according to the invention, FIG. 7 shows a further embodiment of the manicure capsule according to the invention, FIG. 8 shows a finger-hole ring with the elastic terminating wall, FIGS. 9A and 9B respectively show a finger-hole ring without and with an elastic, transversely running band, FIG. 10 shows a longitudinal section through the clippings-collecting container into which the finger-hole rings according to FIGS. 8 and 9B are inserted, FIG. 11 shows a further embodiment of the manicure capsule according to the invention, FIG. 12 shows a finger-hole cap with an elastic terminating wall fastened thereon, FIG. 13 shows a further embodiment of the manicure capsule according to the invention with a slit end region, FIGS. 14A and 14B show further embodiments of an elastic band which can be inserted into the clippings-collecting container from FIG. 13, FIG. 15 shows a finger-hole ring with an elastic terminating wall and a finger-hole ring with a transversely running, elastic band, both rings having retaining pegs, as well as a clippings-retaining bead on its own, said bead having cutouts into which the retaining pegs can be inserted, FIG. 16 shows a further embodiment of the manicure capsule according to the invention with a plug-in slit into which a finger-hole ring with an elastic terminating wall or an elastic band can be plugged, FIG. 17 shows a finger-hole ring in the form of a double ring for securing an elastic terminating wall, FIG. 18 shows a further embodiment of the manicure capsule according to the invention into which nail clippers can be pushed, FIG. 19 shows a view of the manicure capsule according to FIG. 18 from the underside of the manicure capsule, FIG. 20 shows an illustration of the manicure capsule from FIG. 18 with the nail clippers pushed in, FIG. 21 shows a longitudinal section through the manicure capsule from FIG. 20, and FIG. 22 shows an illustration of the manicure capsule according to the invention with the scissors plugged in in order to cut a fingernail.

FIG. 1 shows a first embodiment of the manicure capsule according to the invention. This manicure capsule comprises a clippings-collecting container 1 and a retaining part in the form of a retaining stopper 2 which serves for securing scissors 3 and a nail file 4.

The clippings-collecting container 1 has an end section 5 and a collecting section 6 which adjoins said end section and is intended for cut-off fingernails or other horny tissue.

The retaining stopper 2 can be pushed into the end section 5. For this purpose, the end section 5 is of an essentially elliptical cross-sectional shape with largely parallel top sides and undersides, which are connected to round, i.e. cylindrically shaped, side walls.

The collecting section 6 has a lateral, circular nail-scissors-insertion opening 7 on at least one side. The diameter of the nail-scissors-insertion opening 7 is selected such that it is slightly larger than the width of the scissors 3 in their articulation region, and is otherwise dimensioned such that the scissors 3 plugged in transversely to the longitudinal axis of the cuttings-collecting container 1 can be pivoted in particular forward and rearward, i.e. in the longitudinal plane of the clippings-collecting container 1, and to a certain extent also vertically.

The handling of the manicure capsule according to the invention and of the scissors 3 for cutting fingernails can be seen from FIG. 22.

Although suitable dimensioning of the nail-scissors-insertion opening 7 ensures good guidance with, at the same time, sufficient freedom of movement for the scissors 3, it is expedient for the nail-scissors-insertion opening 7 to be closed by means of an elastic covering part 8 with a central insertion opening 9.

The elastic covering part 8 may, as is illustrated in FIGS. 1 and 2, be an elastic covering membrane, it also being possible for the insertion opening 9 to be designed as a slit. Such a covering membrane 9 is expediently adhesively bonded to the clippings-collecting container 1.

Alternatively, it is also possible for the elastic covering part 8 to be an elastic stopper with an encircling circumferential groove 10 for plugging into the nail-scissors-insertion opening 7, as is shown in FIGS. 3A and 3B. Alternatively, it is also possible for the nail-scissors-insertion opening 7, rather than being circular, to be designed as a longitudinal slot which extends forward from the location of the nail-scissors-insertion opening 7, which is shown in FIG. 1, to the tip of the clippings-collecting container 1 and may even run around the tip to the other side. Such a longitudinal slit is expediently closed by means of an elastic covering part 8, as is illustrated in FIG. 4. The covering part 8 according to FIG. 4 has bristles or lamellae 11, which essentially close the slit and prevent the cut-off horny tissue from dropping out.

The collecting section 6, which adjoins the end section 5, is essentially dome-shaped or torpedo-shaped, its top side and underside being flattened. The clippings-collecting container 1 is closed in the direction of the front side, while it is open in the rearward direction and has a finger-insertion opening 12 there.

The collecting section 6 has a magnifying glass 13 on its top side. This magnifying glass 13 is arranged such that that edge of the fingernail which is to be cut, the relevant finger being inserted through the finger-insertion opening 12, comes to rest beneath the magnifying glass 13 and correspondingly enlarges the cutting region of the fingernail [sic].

Provided between the end section 5 and collecting section 6 is an encircling clippings-retaining bead 14 which projects radially inward from the container wall. This clippings-retaining bead 14 prevents cut-off horny tissue which is collected in the collecting section 6 from slipping out rearward through the finger-insertion opening 12. It is readily possible to provide, instead of an encircling clippings-retaining bead 14, a bead which extends merely over the base region and some way upward in the direction of the side regions, while being absent from the top side.

The clippings-collecting container 1 is formed in a single piece from a plastic injection molding, the magnifying glass 13 already having been integrated. It is expedient for at least the collecting section 6 to be transparent, with the result that the front part of the finger can be seen from all sides.

The shape of the retaining stopper 2 is adapted to the end section 5 such that it can be plugged into the end section 5 and drawn out of the same again. In the plugged-in state, the retaining stopper 2 butts against the clippings-retaining bead 14, which thus forms a push-in stop. Alternatively, it is also possible for a finger-hole ring 26 according to FIGS. 8, 9B or 16, which will be described in more detail at a later stage in the text, to be arranged in the immediate vicinity of the clippings-retaining bead 14 on the side of the end section 5, said ring thus being located, when the retaining stopper 2 has been pushed in, between the latter and the clippings-retaining bead 14. In this state, the retaining stopper 2 terminates, on the rear side, essentially with the rear border of the end section 5.

The length of the clippings-collecting container 1 is such that, when the scissors 3 are plugged into the retaining stopper 2 to the full extent, they are arranged within the clippings-collecting container 1 up to the scissors handles, while the latter are located outside.

FIG. 5 shows a further embodiment of the manicure capsule according to the invention, in which the retaining part which can be pushed into the end section 5 is designed as a finger-hole cap 15. The shape of the clippings-collecting container 1 is the same as, or similar to, that from FIG. 1.

The finger-hole cap 15 comprises a hollow body with an outer, encircling cap wall 16, the shape of which is adapted to the inner circumferential wall of the end part 5, with the result that it can be pushed into the end section 5. The axial push-in movement may be bounded either, again, by the clippings-retaining bead 14 or via a shoulder 17, which projects radially outward from the cap wall 16 and encircles the rear end of the finger-hole cap 15. At this rear end, the finger-hole cap 15 is partially closed by means of an elastic terminating wall 19 containing a finger-insertion opening 18. The diameter of the finger-insertion opening 18 is such that the terminating wall 19 smugly encloses the inserted finger. This ensures, on the one hand, that the clippings-collecting container 1 is seated firmly on the finger, thus preventing the clippings-collecting container 1 from accidentally slipping or sliding off, and, on the other hand, that cut-off horny tissue cannot drop out from the rear of the clippings-collecting container 1. On account of the elasticity of the terminating wall 19, it is readily possible for fingers of different diameters to be inserted, a good fit of the clippings-collecting container 1 and a sealed termination being ensured in all cases.

FIG. 6 shows a further embodiment of the clippings-collecting container 1 according to the invention. As can be seen, here, the nail-scissors-insertion opening 7 is arranged in the region of a lateral depression 20 which extends forward and rearward from the nail-scissors-insertion opening 7 on both sides. This improves the capacity for pivoting the scissors 3 in the forward and rearward directions during cutting. It should be pointed out that the nail-scissors-insertion opening 7 is expediently located in such a depression 20 in all the embodiments illustrated and described here. At its tip, i.e. in that end region of the clippings-collecting container 1 which is located opposite the end section 5, the clippings-collecting container has, in addition, an opening 21 which serves for disposing of the clippings. Although it is not absolutely necessary, this opening 21 may be closed by means of a stopper (not illustrated specifically in FIG. 6). This stopper may, as can be seen from FIG. 7, comprise a removable capsule tip 22 with a plug-in push-on border 23. In order to make it easier for it to be drawn off, the capsule tip 22 may be provided with outwardly projecting protuberances 24.

FIGS. 8 and 9B show two embodiments of retaining parts for securing the clippings-collecting container 1 on the finger which can be inserted into an inner circumferential groove 25 of the clippings-collecting container 1, said circumferential groove being illustrated in FIG. 10. The retaining part from FIG. 8 comprises an encircling finger-hole ring 26 which serves as a carrier or frame for the inner elastic terminating wall 19. In this exemplary embodiment, the terminating wall 19 extends, in particular, in the top region and in the side regions, but not in the base region, of the finger-hole ring 26. This ensures that the inserted finger is kept close to the base of the clippings-collecting container 1, as a result of which the distance to the top side of the clippings-collecting container 1, and thus the distance to the magnifying glass 13, remains constant. This is advantageous in terms of the fixed focal length of the magnifying glass 13 and thus for the sharpness of the magnifying-glass image.

In the embodiment according to FIGS. 9A and 9B, the finger-hole ring 26 has two opposite notches 27 which are provided at a predetermined height in the side regions of the finger-hole ring 26. These notches 27 serve for fitting or fastening an elastic band 28 which extends transversely through the interior of the finger-hole ring 26. In this exemplary embodiment, the finger-insertion opening 18 is located between the base-side border of the finger-hole ring 26 and the elastic band 28. The elastic band 28, in turn, is arranged such that it forces the inserted finger downward. Furthermore, it is also possible for the elastic band 28 to be designed in the form of a rubber cord or spring.

The advantage of such a finger-hole ring 26 which can be plugged into the clippings-collecting container 1 is that it can be readily exchanged if finger-insertion openings 18 of different sizes are desired.

FIG. 11 shows an exemplary embodiment in which a finger-hole ring, which may be designed, for example, according to FIGS. 8 and 9B, is fixed axially from the rear, and can be prevented from dropping out in the rearward direction, by means of a hollow fixing stopper 29 which can be plugged into the end section 5. This fixing stopper 29 may be designed in the same way as, or similarly to, the finger-hole cap 15 illustrated in FIG. 5, although there is no longer any rear terminating wall 19 provided since the function of the latter is assumed by the separate finger-hole ring 26. In conjunction with the fixing stopper 29, there is no need either for any circumferential groove 25, which is shown in FIG. 10, since the finger-hole ring 26 is retained axially in the forward direction by the clippings-retaining bead 14.

FIG. 12 shows an illustration solely of a finger-hole cap 30, which is designed quite similar to the finger-hole cap 15 from FIG. 5, although the elastic terminating wall 19 is arranged in the front end region rather than in the rear end region.

FIG. 13 shows a further embodiment of the clippings-collecting container 1 according to the invention, which, in its end section 5, has two opposite, lateral insertion slits 31 for the elastic band 28. These insertion slits 31 extend over the entire length of the end section 5. In this embodiment, the elastic band 28 has, in its two end regions, thickened portions 32 which are higher than the height of the insertion slits 31. When the elastic band 28 is pushed into the insertion slits 31, the thickened portions 32 slide along the outside of the end section 5 and prevent the ends of the elastic band 28 from being drawn inward. The length of the elastic band 28 is such that said band is stretched within the finger-insertion opening 12 of the end section 5. This embodiment allows very easy fitting and, if appropriate, exchange of the elastic band 28.

It is also possible for the elastic band 28, as is shown in FIG. 14A, to be designed as an elastic ring which is pushed into the insertion slits 31 and otherwise grips over the outside of the end section 5, on the underside or top side thereof. Furthermore, it is also possible for the elastic band 28 to be designed as a spring with thickened portions 32 at the ends, as is illustrated in FIG. 14B.

It is illustrated schematically in FIG. 15 that the finger-hole ring 26 with elastic band 28, as is illustrated quite similarly in FIG. 9B, or the finger-hole ring 26 with elastic terminating wall 19, as is illustrated quite similarly in FIG. 8, has pegs 33 which project in the longitudinal direction of the clippings-collecting container 1 and can be pushed into longitudinal grooves 34 of the clippings-retaining bead 14 in order to arrest the finger-hole ring 26. Solely to give better clarity, the clippings-retaining bead 14 is illustrated on its own in FIG. 15, although it is an integral constituent part of the clippings-collecting container 1, as is illustrated by way of example in FIG. 1.

FIG. 16 shows an alternative embodiment of the clippings-collecting container 1 according to the invention which, in the transition region between the end section 5 and collecting section 6, has a transversely running, vertical plug-in slit 35 into which the finger-hole ring 26 can be plugged. In order to retain the end section 5 on the collecting section 6, the plug-in slit 35 only extends approximately over ¾ of the circumference of the clippings-collecting container 1, with the result that an axial connecting section 36 is provided in the base region. In this embodiment, the finger-hole ring 26, rather than being of encircling design, expediently extends likewise only over approximately ¾ of the overall circumference, i.e. over approximately 270°. The length of the recessed part of the finger-hole ring 26 corresponds to the circumferential length of the connecting section 36. As can be seen from FIG. 16, either the finger-hole ring 26 with elastic band 28 or the finger-hole ring 26 with elastic terminating wall 19 can be plugged into the plug-in slit 35 from above, as a result of which the plug-in slit 35 is fully closed. In order that it can be drawn out easily, the finger-hole ring 26 has a radially outwardly projecting gripping lug 37 on its top side. Other auxiliary means for drawing out the finger-hole ring easily, for example grooves, protuberances, etc. on the finger-hole ring 26, are conceivable.

It can be seen from FIG. 17 that the finger-hole ring 26 may also have a double border.

FIGS. 18 to 21 show a further embodiment of the invention, in which the clippings-collecting container 1 has an additional push-in nail-clippers compartment 38 which is accessible from the front side of said container.

In order for it to be possible for nail clippers 40 to be pushed, with their rear end in front, into the clippings-collecting container 1 from the tip of the latter, the base wall of the clippings-collecting container 1 has an elongate cutout 39 which extends rearward from the tip approximately over half the length of the collecting section 6. In the upward direction, the push-in compartment 38 is separated off by a partition wall 31 which extends obliquely downward from the tip of the clippings-collecting container 1 to the clippings-retaining bead 14. The partition wall 41 is connected firmly to the clippings-collecting container 1 and forms a bearing surface for the nail clippers 40, which are inserted parallel to the same. The cutout 39 provides the necessary clearance, when the actuating lever 43 is pressed, for full closure of the cutting edges 44 of the nail clippers and allows the nail clippers 40 to be pushed into the push-in compartment 38. The elongate cutout 39 is of approximately the same width as the nail clippers 40, with the result that the bottom leg 42 of the nail clippers 40 closes the elongate cutout 39.

The actuating lever 43 of the nail clippers 40 projects downward beyond the clippings-collecting container 1, with the result that it can be actuated from the outside. It can be seen from FIGS. 20 and 21 that, with the exception of their actuating lever 43, the nail clippers 40 are located entirely within the clippings-collecting container 1, the cutting edge 44 of the nail clippers being arranged in the region of the tip of the clippings-collecting container 1. The clipped-off nails drop into the region between the bottom leg 42 and the top leg 45 of the nail clippers 40 and remain in the push-in compartment 38. Once the nail clippers 40 have been drawn out, the clipped-off nails can be disposed of by being tipped out.

The push-in compartment 38 makes it possible both for clipped-off fingernails or toenails to be collected in a controlled manner and for the nail clippers 40 to be stored easily in a space-saving manner.

It is also conceivable for components from the exemplary embodiments which have been illustrated and described to be combined in ways which have not been illustrated specifically. For example, it is readily possible for the clippings-collecting container 1 according to FIGS. 6, 7, 10, 11, 13, 16, 18 to 22 to be provided with an additional retaining stopper 2 for scissors 3 and/or a nail file 4. Furthermore, it is also possible for the retaining stopper 2 from FIG. 1 and the finger-hole cap 15 from FIG. 5 to be designed not as plug-in parts, but as a plug-on part which engages over the end section 5.

What is claimed is:

1. Manicure capsule having an at least partially transparent clippings-collecting container (1) which has an end section (5), enclosing a finger-insertion opening (12), and a collecting section (6) adjoining said end section, characterized in that the clippings-collecting container (1) has at least one lateral nail-scissors-insertion opening (7), and the end section (5) of the clippings-collecting container (1), said end section enclosing the finger-insertion opening (12), is designed as a retaining section for a retaining part which can be fastened releasably on the end section (5) and is intended for at least one pair of scissors (3).

2. Manicure capsule according to claim 1, characterized in that the retaining part for at least one air of scissors (3) is designed as a retaining stopper (2) which can be plugged into the end section (5) or a retaining cap which can be plugged onto the end section (5).

3. Manicure capsule according to claim 1, characterized in that the retaining part has one plug-in slit for the scissors (3) and an additional plug-in slit for a nailfile (4).

4. Manicure capsule according to claim 1, characterized in that the retaining part for securing the clippings-collecting container (1) can be secured axially by means of a hollow fixing stopper (29) which can be plugged into the end section.

5. Manicure capsule according to claim 1, characterized in that provided in the clippings-collecting container (1) is an encircling clippings-retaining bead (14) which projects radially inward from the container wall and bounds the collecting section (6) in the direction of the end section (5).

6. Manicure capsule according to claim 5, characterized in that the clippings-retaining bead (14) is designed as a push-in stop for the retaining part.

7. Manicure capsule according to claim 1, characterized in that the clippings-collecting container (1) is provided with a magnifying glass (13) on its top side and/or underside.

8. Manicure capsule according to claim 1, characterized in that, in its end region which is located opposite the end section (5), the clippings-collecting container (1) has an opening (21) which can be closed by means of a closure stopper.

9. Manicure capsule according to claim 1, characterized in that the clippings-collecting container (1) has two diametrically opposite lateral nail-scissors-insertion openings (7).

10. Manicure capsule according to claim 1, characterized in that the clippings-collecting container (1) has a container depression (20) adjoining the nail-scissors-insertion opening (7) laterally.

11. Manicure capsule according to claim 1, characterized in that the nail-scissors-insertion opening (7) is closed by an elastic covering part (8) which has a central insertion opening (9) for a manicuring implement.

12. Manicure capsule according to claim 1, characterized in that the nail-scissors-insertion opening (7) comprises an elongate lateral window which is closed by a bristle or lamella screen.

13. Manicure capsule according to claim 1, characterized in that the clippings-collecting container (1) has a push-in nail-clippers compartment (38) which is accessible from the front side of said container and is bounded, on the underside, by the base of the clippings-collecting container (1) and, on the top side, by a partition wall (41) which extends obliquely downward from the tip of the clippings-collecting container (1) to the bottom border of the end section (5).

14. Manicure capsule having an at least partially transparent clippings-collecting container (1) which has an end section (5), enclosing a finger-insertion opening (12), and a collecting section (6) adjoining said end section, characterized in that the clippings-collecting container (1) has at least one lateral nail-scissors-insertion opening (7), and the end section (5) of the clippings-collecting container (1), said end section enclosing the finger-insertion opening (12), is designed as a retaining section for a retaining part which can be fastened releasably on the end section (5) and is intended for securing the clippings-collecting container (1) on the finger.

15. Manicure capsule according to claim 14, characterized in that the retaining part for securing the clippings-collecting container (1) on the finger comprises a finger-hole cap (15) which is adapted to the shape of the end section (5), can be plugged into or onto the latter and on one side of which there is provided an elastic terminating wall (19) which contains a finger-insertion opening (18) and encloses the inserted finger elastically.

16. Manicure capsule according to claim 14, characterized in that the retaining part for securing the clippings-collecting container (1) on the finger comprises a finger-hole ring (26) which can be fixed within the end section (5) and has an elastic terminating wall (19) which is stretched over the finger-hole ring (26), contains a finger-insertion opening (18) and encloses the inserted finger elastically.

17. Manicure capsule according to claim 14, characterized in that the retaining part for securing the clippings-collecting container (1) on the finger comprises a finger-hole ring (26) which can be fixed within the end section (5) and has an elastic band (28) which is fastened on two opposite sides of the finger-hole ring (26) and extends in a chord-like manner through the interior of the finger-hole ring (26).

18. Manicure capsule according to claim 14, characterized in that the retaining part for securing the clippings-collecting container (1) on the finger comprises an elastic band (28), and the end section of the clippings-collecting container (1) is provided with lateral insertion slits (31) into which the elastic band (28) can be pushed, with the result that the elastic band (28) extends in a chord-like manner onto the interior of the end section (5).

* * * * *